United States Patent [19]

Garritsen et al.

[11] 4,288,305

[45] Sep. 8, 1981

[54] PROCESS FOR ELECTROWINNING NICKEL OR COBALT

[75] Inventors: Petrus G. S. Garritsen, Welland; Douglas J. MacVicar, Port Colborne; Daniel P. Young, Sherkston; John G. Sojda, Welland, all of Canada

[73] Assignee: Inco Limited, Toronto, Canada

[21] Appl. No.: 178,819

[22] Filed: Aug. 18, 1980

[30] Foreign Application Priority Data

Oct. 10, 1979 [CA] Canada ..... 337248

[51] Int. Cl.[3] ..... C25C 1/08; C25B 15/08

[52] U.S. Cl. ..... 204/112; 204/113; 204/DIG. 1

[58] Field of Search ..... 204/112, 113, DIG. 1

[56] References Cited

U.S. PATENT DOCUMENTS

| | | | |
|---|---|---|---|
| 415,576 | 11/1979 | Siemens | 204/112 |
| 3,432,410 | 3/1969 | Cuenot | 204/113 |
| 4,087,339 | 5/1978 | Elliott et al. | 204/112 |

FOREIGN PATENT DOCUMENTS

| | | | |
|---|---|---|---|
| 1020115 | 11/1977 | Canada | 204/106 |
| 1478502 | 7/1977 | United Kingdom | 204/113 |

*Primary Examiner*—R. L. Andrews

*Attorney, Agent, or Firm*—Raymond J. Kenny; Edward A. Steen

[57] ABSTRACT

A process for electrowinning nickel or cobalt from an electrolyte in apparatus having spaced insoluble anodes and cathodes. Each anode is provided with diaphram means for defining an anolyte compartment. A frothing agent is introduced into the feed electrolyte which expedites the withdrawal of spent electrolyte and anodically generated gases.

5 Claims, 2 Drawing Figures

PROCESS FOR ELECTROWINNING NICKEL OR COBALT

FIELD OF THE INVENTION

The present invention relates to an improved process for electrowinning nickel or cobalt.

BACKGROUND OF THE INVENTION

In processes where nickel or cobalt is electrowon from electrolytes containing sulfate and/or chloride ions, the metal in question is deposited at the cathodes while, depending on the anions present, chlorine or oxygen is evolved at the anodes. The evolution of oxygen in the case of sulfate electrolytes is accompanied by a lowering of the pH due to sulfuric acid formation.

A permeable membrane or diaphragm is placed between each anode and cathodes adjacent to it. In the case of electrowinning from chloride electrolytes the diaphragm serves the purpose of confining the anodically generated chlorine to the vicinity of the anodes, which can be provided with suitable hoods for avoiding environmentally objectionable fuming. In the case of electrowinning from sulfate electrolytes the diaphragm serves to confine the low pH conditions to the vicinity of the anode, thereby ensuring that the bulk of the electrolyte remains at the less acidic pH needed to ensure that nickel or cobalt deposition occurs in preference to hydrogen evolution.

In order to prevent back-diffusion of chlorine or acidic anolyte into the bulk electrolyte compartment, a positive flow of electrolyte is maintained from cathode to anode through the diaphragm. One way of accomplishing this flow involves using a diaphragm which surrounds an anode, i.e., a diaphragm bag, so that the space within each anode bag constitutes an anolyte compartment, while the space outside the bags constitutes the bulk electrolyte of the cell. Such an arrangement is described for example in co-pending application for letters patent, Ser. No. 288,455, filed on Oct. 17, 1977 and assigned in common with the present invention.

A problem which is encountered in any such bagged anode operation is the difficulty in maintaining identical conditions in the various anolyte compartments of a given tank. Should there be variations between the rate at which electroltye is withdrawn from the various anolyte compartments, the resulting high anolyte level creating an undesirable hydrostatic head in combination with the constantly growing acid concentration can cause back diffusion from one or more of the anode bags and this in turn leads to current inefficiency and possibly environmental problems if acid mist or chlorine gas escape from the unhooded bulk electrolyte.

In the past, it has been suggested to withdraw gases by suction from the sealed space above each anolyte, and to withdraw the anolyte itself from a discharge outlet provided in the side of the anode bag. Alternatively, it has been proposed to remove both liquid and gases from a single outlet in the side of the anode bag. With either of these arrangements, we have found flow equalization difficult to achieve. Relatively small variations, such as a fraction of an inch, between the elevations of the various anolyte outlets leads to unacceptable variations in the anolyte flow.

OBJECT OF THE INVENTION

The invention is aimed at providing a bagged anode electrowinning process wherein electrolyte flow through the various individual cells can be conveniently equalized.

SUMMARY OF THE INVENTION

It has now been discovered that if a small amount of frother is included in the electrolyte, a bagged anode electrowinning operation can be carried out by withdrawing electrolyte and gases together as a froth from the anolyte compartment. When this is done a steady rather than intermittent withdrawal is achieved, and equalized flows are obtained despite any minor variations in the elevation of the withdrawal apertures of various cells.

Accordingly, the present invention provides a process for electrowinning nickel or cobalt from an electrolyte in apparatus having spaced insoluble anodes and cathodes, each anode being provided with diaphragm means for defining an anolyte compartment surrounding the submerged portion of the respective anode, wherein feed electrolyte is introduced into the space between anolyte compartments and spent electrolyte is withdrawn from within each anolyte compartment, and wherein the improvement consists of including in the feed electrolyte an amount of frothing agent sufficient to ensure the formation of a stable froth at least 3 centimeters thick on the electrolyte surface within the anolyte compartments, and withdrawing froth continuously from each of the anolyte compartments, thereby simultaneously withdrawing from the apparatus spent electrolyte and anodically generated gases.

The process of the invention is equally applicable to the electrowinning of either of the metals, nickel and cobalt, from sulfate, chloride or mixed ion media. According to a preferred feature of the invention anodes are used which are equipped with flange portions near the unsubmerged extremities thereof. The diaphragm means in such a case can consist of a simple sleeve-like member secured at one end to the flange and closed at the opposite end. The presence of a stable froth above the anolyte is essential to the success of the process in ensuring simultaneous withdrawal of gases and spent electrolyte. The requisite froth can be maintained by including in the feed electrolyte any convenient frothing agent which does not introduce unacceptable ionic species into the system. Many surface active agents commercially sold as flotation reagents may be used for this purpose, such as for example those sold by The Dow Chemical Company of Midland, Mich., USA under the trademark "DOWFAX". More specifically a frothing agent which we have found to give excellent results in our process is sodium lauryl sulfate, at a concentration of 10–50 mg/l, eg., 30 milligrams thereof per liter of electrolyte has been found to provide the stable froth desired. A froth thickness (i.e., depth) of at least 3 cm should be maintained on the anolyte surface to ensure a smooth continuous withdrawal, and preferably the cell is operated with a froth thickness of between 5 and 10 cm.

The invention will now be described with reference to a preferred embodiment thereof illustrated in the accompanying drawings.

DETAILED DESCRIPTION OF THE EMBODIMENT

Figure 1:
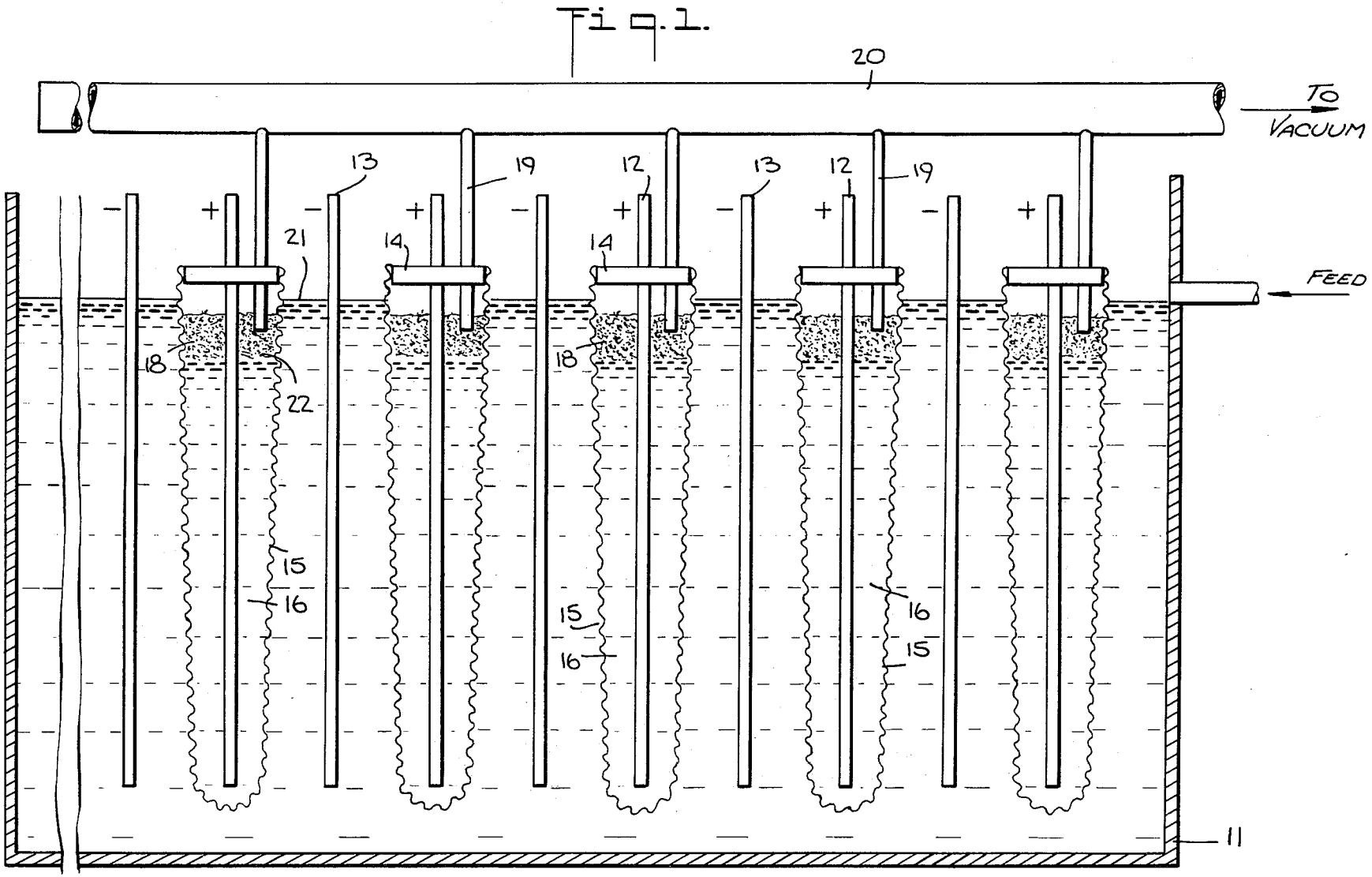
FIG. 1 is a schematic cross-sectional illustration of part of an electrowinning tank for carrying out the process of the invention.

In the view of FIG. 1 only portions of the apparatus germane to the present invention are illustrated and such standard features as the electrode cross-bars and the bus bars on which they rest have been omitted for the sake of simplicity. The tank 11 is seen to house a plurality of anode plates 12 which are spaced apart and have a plurality of cathodes 13 interleaved between them. The cathodes are preferably also plates, though other geometric forms may be used. Both the anodes and the cathodes are made from a material insoluble in the electrolyte to be used and may have a composite structure as is well known. Each anode is provided with an integral shoulder 14 constituting a flange to which the open end of an anode bag 15 is suitably secured. The anode bag defines an anolyte compartment 16 while the catholyte 17 occupies the bulk of the tank volume outside the anode bags. The anodically generated gases cause a "head" of froth 18 to be maintained above the anolyte level in each bag, and froth withdrawal tubes 19 terminate at a point within the froth layer. The withdrawal tubes communicate with a common header pipe 20 which is connected to a source of reduced pressure (not illustrated). The cell level 21 is maintained by recirculation of catholyte via the feed inlet and the anolyte is withdrawn to maintain the anolyte level 22 thereby ensuring electrolyte flow in the desired direction through the bags.

Figure 2:
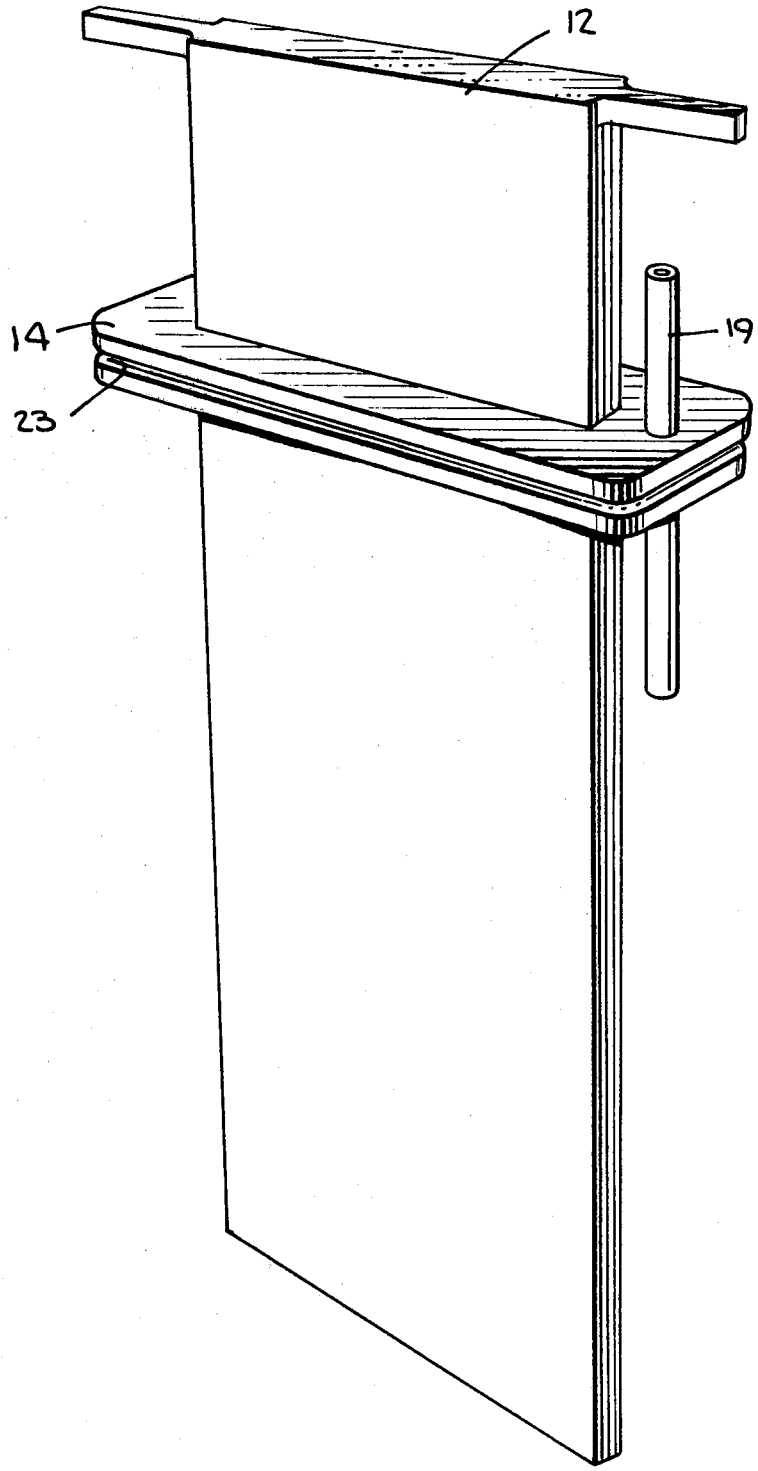
FIG. 2 is a schematic perspective view of an anode used in the apparatus of FIG. 1.

The anode construction is shown more clearly in FIG. 2 where it will be seen that the integral flange 14 of each anode 12 is provided with a peripheral groove 23. The latter serves to house, at least partially, an "O" ring used to secure the anode bag to its respective electrode.

Apparatus of the type described above was used in tests to evaluate the process of the invention for electrowinning cobalt from sulfate as well as mixed sulfate-chloride electrolytes. In each of the tests according to the invention 30 mg/l of sodium lauryl sulfate were present in the feed electrolyte which had a cobalt concentration of about 100 g/l and a pH of about 5. For the sake of comparison tests were carried out in the same apparatus without the presence of any frothing agent in the feed electrolyte. After several tests during which cobalt was electrowon at 50°–60° C. for periods of 5–10 days with a current density of about 200 amperes per square meter, the following observations could be made:

(1) In tests in accordance with the invention the height of the withdrawal tubes was found not to be critical.

(2) Flow equalization and elimination of back diffusion of acid was shown by the fact that the sulfuric acid concentration in anolyte withdrawn from various compartments ranged only between 70 and 90 grams acid per liter. In contrast, when no frother was present in the electrolyte, anolyte acid concentration was found to vary between 40 and 100 g/l.

(3) The elimination of acid back diffusion was seen from the fact that the catholyte pH under conditions of balanced feed rate and withdrawal rate was 3.5 in the tests according to the invention, but only 2.5 in the comparative tests which results in a higher current efficiency using the invention.

(4) Samples of atmosphere above the cell were analyzed for cobalt and it was found that only 0.01–0.2 $mg/m^3$ were present in the tests according to the invention whereas as much as 0.1–0.3 $mg/m^3$ were detected in the absence of the frother withdrawal system. Even when comparative tests were carried out with added alkali to ensure a catholyte pH of 3.5 as in the tests where frother was present, the comparative tests still gave the same high cobalt contamination of the atmosphere. The latter is therefore attributable not to the acidic conditions but rather to misting produced by the release of anodically generated gas which has diffused through the diaphragm into the catholyte.

While the present invention has been described with reference to preferred embodiments thereof, it will be appreciated that additions and modifications may be made to the details of such embodiments without departing from the scope of the invention which is defined in the appended claims.

The embodiments of the invention in which an exclusive property or privilege is claimed are defined as follows:

1. In a process wherein nickel or cobalt is electrowon from an electrolyte in apparatus having alternately spaced insoluble anodes and cathodes, each anode being provided with diaphragm means for defining an anolyte compartment surrounding the submerged portion of the respective anode, and wherein feed electrolyte is introduced into the space between anolyte compartments and spent electrolyte is withdrawn from within each anolyte compartment, the improvement consisting of including in the feed electrolyte an amount of frothing agent sufficient to ensure the formation of a stable froth at least 3 centimeters thick on the electrolyte surface within the anolyte compartments, and withdrawing froth continuously from each of the anolyte compartments, thereby simultaneously withdrawing from the apparatus spent electrolyte and anodically generated gases.

2. A process in accordance with claim 1 wherein each anode is provided with a flange portion adjacent the unsubmerged end thereof, the diaphragm means comprising a sleevelike member closed at the lower end thereof and sealed at the upper end thereof to the flange portion of the anode, thereby surrounding an anolyte compartment and a freeboard space above the anolyte compartment.

3. A process in accordance with claim 2 wherein each anode is provided with a froth-withdrawal tube which traverses the flange portion of the anode and, in operation, is connected at the upper end thereof to a source of reduced pressure, and terminates at the lower end thereof at a point within the freeboard space.

4. A process in accordance with claim 1 wherein the frothing agent present in the feed electrolyte comprises sodium lauryl sulfate.

5. A process in accordance with claim 4 wherein the amount of frothing agent present is about 10–50 milligrams per liter of electrolyte.

* * * * *